US005789031A

United States Patent [19]

Hirabayashi et al.

[11] Patent Number: 5,789,031

[45] Date of Patent: Aug. 4, 1998

[54] PROCESS FOR MANUFACTURING COATED PAPER

[75] Inventors: Tetsuya Hirabayashi; Hideyuki Suzuki; Terunobu Fukui, all of Amagasaki, Japan

[73] Assignee: Oji Paper Co., Ltd., Tokyo, Japan

[21] Appl. No.: 766,103

[22] Filed: Dec. 16, 1996

Related U.S. Application Data

[62] Division of Ser. No. 561,709, Nov. 22, 1995, abandoned.

[30] Foreign Application Priority Data

Mar. 30, 1995 [JP] Japan ..... 7-073585
Mar. 30, 1995 [JP] Japan ..... 7-073586

[51] Int. Cl.[6] ..... B05D 1/38; B05D 3/12; D21F 11/00; D21F 19/36

[52] U.S. Cl. ..... 427/341; 427/342; 427/361; 427/364; 427/365; 427/382; 427/391; 427/395; 427/411; 162/136; 162/175; 162/207

[58] Field of Search ..... 162/207, 175, 162/136; 427/335, 339, 341, 342, 361, 362, 364, 382, 391, 395, 365, 411

[56] References Cited

U.S. PATENT DOCUMENTS 4,370,389 1/1983 Ogura et al. ..... 428/511
4,642,164 2/1987 Hanhikoski et al. ..... 162/207
4,786,529 11/1988 Boissevain ..... 427/296
4,900,583 2/1990 Hirabayashi et al. ..... 427/55
5,106,655 4/1992 Boissevain et al. ..... 427/296

FOREIGN PATENT DOCUMENTS 49-048592 12/1974 Japan .
55-148191 11/1980 Japan .
2080694 3/1990 Japan .
4296590 10/1992 Japan .
4327295 11/1992 Japan .
7305297 11/1995 Japan .

OTHER PUBLICATIONS

Translation of JP 02–080694, Mar. 1990.
Hirabashi et al. "New Technique to Reduce Printing–Mottle–Smoothing of Starch Distribution", Tappi Press. May 1995 Coating Conference, pp. 247–267.

*Primary Examiner*—Erma Cameron
*Attorney, Agent, or Firm*—Flynn, Thiel, Boutell & Tanis, P.C.

[57] ABSTRACT

A process for manufacturing a coated paper for use in printing is characterized in that the coated paper for printing is produced by coating a color consisting mainly of pigment and a water-soluble binder made of starch or starch derivatives to the surface of a base paper, then drying and finishing it. Steam or an aqueous penetrant solution having a penetrating force of less than 50 seconds is sprayed or applied over the dry coated layer surface of the coated paper, prior to it being finished with a calender, for redistributing the water-soluble binder in the coated layer in order to correct its uneven distribution, which is the cause of printing mottle during the offset printing operation.

7 Claims, No Drawings

PROCESS FOR MANUFACTURING COATED PAPER

This application is a division U.S. Ser. No. 08/561,709, filed Nov. 22, 1995 now abandoned.

FIELD OF THE INVENTION

The present invention relates to a process for manufacturing coated paper and, particularly, to a process for making coated paper used in printing which can solve the problem of printing mottle in offset printing, and can have a more favorable print finish.

BACKGROUND OF THE INVENTION

Among the defects of printed matter produced from offset printing in general, one problem caused by the quality of the coated paper used in the printing is printing mottle.

This printing mottle is considered to be caused by uneven ink trapping at the rear impression cylinder, or uneven fountain solution absorption. Namely, printing mottle is caused by the uneven distribution of the coated layer ingredients at the near surface. In coated or art paper with a relatively large coat volume, the uneven distribution of binder over the coated layer surface seems to be especially influential in the occurrence of printing mottle.

As the binder, one of the main components of the coated layer, a water-soluble binder made of starch, starch derivatives, etc. or copolymer emulsions made of styrene-butadiene copolymer latex, etc. can be used. It is felt that when an aqueous coating color containing this binder is applied to the base paper surface and dried to form the coated layer, the binder migrates unevenly into the base paper or coated layer surface, resulting in its uneven distribution in the coated layer or over its surface. Among others, water-soluble starch is easily unevenly distributed to cause printing mottle.

To prevent such uneven migration of the binder, it is desirable not to dry the paper web rapidly or excessively in the coated paper manufacturing process, but to dry it as slowly as possible, especially at the drying zone of the web where much of the water evaporates, thus avoiding any uneven distribution of the binder.

However, the coaters and any paper machine equipped with the coater are being improved to operate at a higher speed for raising the productivity; e.g., they are designed to operate with an enhanced drying capacity to meet the requirements for drying the paper web with an increased air volume blown at a higher speed and at a higher drying temperature. Moreover, the humidity has been lowered in the hot air circulation, etc., as one of the coater operating conditions.

If the coated paper is manufactured under these operation conditions, it is clear why the manufactured coated paper degrades in its quality, because by these operating conditions, the water-soluble binder is forced to be unevenly distributed over the coated layer surface, and as a result, the coated paper with these uneven water-soluble binder distributions will have the problem of highly noticeable printing mottle in offset printing.

To prevent uneven migration in the drying process of the pigments and water-soluble binders, like starch, starch derivatives, etc. contained in the coating color, methods are known that reduce the compounding rate of water-soluble starch, which is the most mobile of all types of binders, or adding an agent that can promote the immobilization of coating ingredients, etc. The former method is effective as a measure against printing mottle unless there is a problem in the quality and cost requirement for the final products, but if coating ingredients in which the amount of starch mixed therewith has been reduced are used, it may cause other problems such as the deterioration of coating suitability, especially the water retention, and also may reduce the stiffness of the product. The latter method also has problems in the increase of the coating color's viscosity, storage instability, etc. So both methods were not a desired means to solve the problems.

SUMMARY OF THE INVENTION

The object of the present invention is to provide a process for manufacturing coated paper for printing, comprising applying a coating color consisting of pigments and a water-soluble binder made of at least one of starch and starch derivatives to the base paper surface, then drying and finishing the coated paper; said process being able to eliminate printing mottle that easily occurs in offset printing without being affected by the drying conditions or the quality of base paper used, and without sacrificing the product quality and production cost.

Namely, a process for manufacturing the coated paper for printing developed by the present invention comprises applying an aqueous coating color consisting of pigment and a water-soluble binder made of at least one of starch and starch derivatives to the base paper, then drying it to form a dry coated layer thereon and finishing said coated paper; said coating color applying and drying process including adding steam in an amount of 0.5~4.0 g/m$^2$ to said dry coated surface, or applying an aqueous penetrant solution with a penetrating velocity of less than 50 seconds, when measured by the canvas disk method, to said coated layer surface, for the redistribution of said water-soluble binder in said coated layer, and then finishing the coated paper with a calender.

The object of the present invention, as mentioned above, is to provide a method which can reduce or eliminate uneven binder distribution in the coated layer, particularly water-soluble binders made of at least one of starch and starch derivatives, thereby solving the problem of printing mottle taking place during printing operation.

DETAILED DESCRIPTION

In a more detailed description of the method according to the present invention, a coating color containing water-soluble binders made mainly of starch or starch derivatives is applied to the base paper surface, then dried to the extent that the moisture content of said coated paper may be 0.5~10 wt %, more preferably 3~8 wt %, and then steam is sprayed over the coated layer surface in an amount of 0.5~4.0 g/m$^2$/surface, more preferably 1.0~3.0 g/m$^2$/surface, or an aqueous penetrant solution with a penetrating speed of less than 50 seconds, more preferably less than 30 seconds, is applied to the surface in an amount of 1~10 g/m$^2$/surface, more preferably 2~6 g/m$^2$/surface, and then dried by heat if necessary to the extent that the moisture content of the coated paper becomes about 3~8 wt %, followed by finishing the coated paper with a calender as it is, or winding it up before finishing it with a calender.

According to the present invention, the coated layer surface, after being dried once, has steam or an aqueous penetrant solution applied thereto to smooth the distribution of binders made mainly of starch (or starch derivatives) thereover. Both the steam and aqueous penetrant solution instantly re-dissolve or re-swell the part of the starch binder which is unevenly distributed within the coated layer surface, especially near the surface, by the force of steam energy or penetrant solution, thereby redistributing said water-soluble binders therein in a very short time. By treating and finishing the thus-obtained coated paper with a calender into one for use in printing, and then using it in offset printing, it is possible to obtain a product with its printing mottle drastically reduced or totally removed as is intended by the present invention.

Similar effects according to the present invention can, of course, be attained also by simply applying water over the coated layer surface, then leaving it to dry naturally—without applying any artificial force for drying, and then treating the coated paper with a calender. But in this case, a great deal of time is needed for the moisture to evaporate from the paper, which is not of practical use nowadays when high-speed production is imperative.

Uniform distribution of water-soluble binder in the coated layer surface can hardly be expected from any forced drying by heat in the water treatment process, because it can be guessed that if heating is used to dry the water-soluble binder while being evenly dispersed or swelling after the water is added, this could rather promote uneven distribution in the redistribution process.

Meanwhile, the penetrant solution used in the present invention has a much larger force of penetration into the coated layer surface than water so it can swell or re-dissolve the water-soluble binder in a short time for their redistribution, besides bringing the water-soluble binder to the base paper side with its strong penetrative force. As a result, this aqueous penetrant solution, even if it is dried by heat, can prevent the migration of the dissolved binder, and can maintain the redistributed state of the water-soluble binder as it is, thus permitting it to obtain better distribution of the binder than when water is used.

According to the present invention, the wetting steam in the amount of 0.5~4.0 g/m$^2$ is enough to have the intended effect as mentioned above. For instance, if about 1 g/m$^2$ steam is applied to wet the dry coated layer surface, it is used up almost instantly by being absorbed into the coated layer and redistributing the water-soluble binder therein, and so the coated layer surface instantly recovers its nearly dry state. Therefore the coated paper can successively be finished with a calender or wound up if necessary before being finished as it is. On the other hand, when a relatively large amount of steam, i.e., 4.0 g/m$^2$, is applied, the coated layer surface remains wet for some time after the steam dampening. In this case, the coated paper is put to a heat treatment for drying if necessary, and after its surface is dried, it is finished with a calender or once wound up prior to the finish-by-calender process. Incidentally, if the coated paper with its coated layer surface being still wet is calendered for finishing or wound up, trouble may occur in that part of the coated layer surface is taken by the calender roll surface, or blocking may occur when winding up the paper.

By the way, in the above drying by heating, the coated layer surface is wetted with steam, so the moisture given is heated itself unlike when the usual water is used, and therefore the coated layer surface can easily be dried by a low-temperature heat. It is therefore desirable to avoid a high temperature but use a mild or low one for drying the coated layer surface from the viewpoint of eliminating the printing mottle.

The steam used according to the present invention is a low-pressure steam with a pressure of about 0.3~2.0 kg/cm$^2$, and is used at a flow rate of about 20~200 kg/Hr/m. Further, as the device to apply steam to the coated layer surface, there are available, for instance, Steam Foil (tradename) mfd. by Aikawa Ironworks, Gross Trol (tradename) by Measurex Corporation, Calendizer (tradename) by Debron Hercules, etc.

Next, a detailed explanation will be given about the case where an aqueous penetrant solution is applied to the coated layer surface. As mentioned previously, according to the present invention, besides steam dampening, an aqueous penetrant solution with a penetration force of less than 50 seconds, measured by the canvas disk method, is applied to the coated layer surface for the redistribution of the water-soluble binder in the coated layer. This point will be detailedly explained below.

The canvas disk method is one generally used for measuring the penetration force of active agents, where a piece of canvas punched into a 1-inch diameter is placed in the solution of an active agent and held down with an upside-down Gooch funnel having no filter plate so as to be kept in the solution. The canvas leaves the funnel when it is wet, so the required time for it to leave the funnel is measured. Judgment is done that the shorter the required time, the larger penetrative force becomes the active agent has.

In the canvas disk method, the measured results vary according to the canvas material and kind, the solution temperature at the measurement time, etc. In the present invention, #6 canvas mfd. by Tosco was used in the canvas disk measurement method, with the temperature of measured solution set at 25° C., to establish the penetrative force (seconds) of aqueous penetrant solutions (active agents) by this method.

By the way, the penetrative force of penetrant solution to be applied is very important; any penetrant solution with its penetrative force exceeding 50 seconds, when measured by the canvas disk method, is weak in this force, and such penetrant solution, after applied to the coated layer surface, and swelling or separating the water-soluble binder out of the coated layer, tends to remain on the coated layer surface. Consequently, if the coated paper is dried by heat with the penetrant solution still remaining there, the separated water-soluble binders are given an uneven redistribution on the coated layer surface again and no improvement can be done on the printing mottle.

According to the present invention, though there are no particular limitations on the amount of penetrant solution to be applied, it is desirable to adjust the amount within a range of 1~10 g/m$^2$, preferably 2~6 g/m$^2$, to obtain the effect intended by the present invention. Incidentally, if the amount is less than 1 g/m$^2$, the effects of dissolution and redistribution of water-soluble binder will be insufficient, while if it is more than 10 g/m$^2$, the penetrant solution will remain on the coated layer surface even if its penetrative force is strengthened, which may cause secondary uneven distribution of the water-soluble binder, thus making it difficult to satisfactorily remove the problem of printing mottle.

By the way, any one of anionic, cationic and nonionic surface active agents is available as the penetrant solution with no particular limitations applied to their use. According to research by the inventors of the present invention, however, it is confirmed that nonionic surface active agents with an HLB range of 9~14, e.g., polyoxyethylene/polyoxypropylene condensation products, an alcohol ethoxylate, nonylphenol ethoxylate, octylphenol ethoxylate, oleyl alcohol ethoxylate, laurylalcohol ethoxylate, phenol-ethoxylate, polyoxy ethylene glycololate, polyoxyalkylene thaloate, sorbitan stearic ester, sorbitanoleic ester, polyoxy-ethylene sorbitan oleic ester, distearic acid ethylene glycol, fatty acid diethanol amide, fatty acid monoethanol amide, polyoxyethylene-fatty acid monoethanol amide, etc., can serve to reduce or remove the printing mottle.

As the coater for applying the aqueous penetrant solution over the coated layer surface, various types of coaters used in the field of manufacturing the coated paper for general printing, e.g., blade coater, air-knife coater, roll coater, bar coater, gravure coater, spray coater, etc., are suitable.

As explained later with specific data, it was confirmed that in both cases of steam dampening and applying an aqueous penetrant solution, the coated paper obtained showed a large improvement in reducing the printing mottle. The effect is particularly remarkable in the case when starch in a relatively large amount is mixed in the coating color.

It is also clear from the results confirmed by the iodine dyeing test method that the above coated layer surface treatment is effective in making the even redistribution of starch in the coated layer, i.e., a clear distinction could be drawn between the coated paper that underwent the treatment by steam or aqueous penetrant solution and the one that did not. By the way, the above iodine dyeing test method includes heating iodine to generate iodine vapor, exposing the coated layer to the iodine vapor for a certain time, and then exposing it to steam to dye the starch on its surface with the iodine vapor, thereby measuring the starch distribution conditions therein.

The present invention is, of course, applicable to the water-soluble binder, an essential component of the coated layer, which are made of starch or starch derivatives including cationized starch, oxidized starch, thermo-chemically modified starch, denatured enzyme starch, etherified starch, esterified starch, cold water soluble starch, etc., and also to binders containing such subcomponents as cellulose, including carboxylmethyl cellulose, hydroxy ethyl cellulose, etc., polyvinyl alcohol, olefin-maleic anhydride resin, etc., and further to those containing a water-soluble synthetic resin based binder made of the following emulsion type alkali-soluble binders, etc.

In addition to the above, the following can be used at the same time: copolymer emulsion type binders traditionally used in the field of manufacturing the coated paper, more specifically, a conjugate diene-based polymer latex such as styrene-butadiene copolymer, methyl methacrylate-butadiene copolymer, etc., an acrylic polymer latex such as a polymer or copolymer of acrylic acid ester and/or methacrylic acid ester, a vinyl based polymer latex like ethylene-acetic acid vinyl copolymer, etc., and an alkali soluble or alkali non-soluble polymer and copolymer latexes made by denaturing the above-mentioned various copolymers with a functional-group containing monomer such as a carboxyl group, etc.

The binders mixed in the coating color will be adjusted to a content within a range of 3~50 weight % solids, preferably 5~30 wt %, by weight of pigment contained in the coating color. Further, various sub-additives including a water-resisting agent, defoamer, dye, lubricant, rheology modifier, etc. are added to the binder if necessary.

When the amount of water-soluble binder (especially those of starch and starch derivatives) added is in a range of 1~20 weight % solids, preferably 3~15 weight % solids, by weight of coated layer solid content, an excellent effect can be obtained. Incidentally, if the amount is less than 1 wt %, printing mottle can hardly occur so this range is out of the scope of the present invention. Besides, a coating color with such a low starch content has the problems of low water retention and low suitability to the coater operation. On the other hand, if the amount exceeds 20 wt %, the effect of reducing or removing printing mottle can very much be expected, but other problems will occur at the same time regarding the increased coating color viscosity and the difficulty in waterproofing the coated layer, along with the runnability in coaters and product quality.

As the pigment, one of the main components of the coated layer, can be selected for use more than one kind of usual pigment for coated paper like, for instance, clay, kaolin, aluminum peroxide, calcium carbonate, titanium dioxide, barium sulfate, zinc oxide, satin white, calcium sulfate, talc, plastic pigments, etc.

When coated on the base paper, the coating color is applied to one or both sides of the base paper in a single or multi-layers by means of the on- or off machine coaters used in the coated paper manufacturing industry, such as, for instance, a blade coater, air-knife coater, roll coater, reverse roll coater, bar coater, curtain coater, die slot coater, gravure coater, champflex coater, size press coater, etc. The solid content of the coating color to be applied is generally 40~75 wt %, but a 45~70 wt % range is desirable considering the runnability.

As the base paper, a base stock of paper base or board base weighing 30~400 g/m$^2$ is used as the coated printing paper. However, there is no particular limitation on the paper making methods, and both acid and alkali paper will do. Middle-quality base paper containing a high-yield pulp can of course be used. Further, base paper that is preliminarily coated with a size press, roll coater, blade coater, etc. is also available. The amount of coating color applied to the base paper surface is about 3~50 g/m$^2$ per side in dry weight, but should be adjusted within a range of about 8~25 g/m$^2$ considering the quality of coated paper obtained, the coating and printing suitability, etc.

Regarding the calender finishing method, various types of calenders consisting of metal rolls or drums and elastic rolls, including, for instance, super calender, gloss calender, soft compact calender, etc., are used in the form of an on- or off-machine type.

As for the method for drying the wet coated layer, such various methods as, for instance, heating by steam, drying by hot air, heating by gas heater, electric heater, infrared-ray heater, high frequencies, laser, electronic radiation, etc. can be used. Regarding the drying conditions, there are no special limitations on the drying methods, conditions, etc. according to the present invention though it has heretofore been necessary to avoid any rapid or excessive drying method as much as possible in order to prevent any uneven migration of the binder to the coated layer surface.

DESCRIPTION OF THE PREFERRED EMBODIMENTS

The present invention will hereinafter be explained in detail referring to its embodiments, but the spirit of the present invention is, of course, not limited to these embodiments. The terms "part" and "%" in the following descriptions of the embodiments mean "the weight part" and "weight %" respectively unless otherwise specified.

Among the embodiments that follow, embodiments 1 through 5 and references 1 through 4 are the case where steam was either applied or not applied, while embodiments 6 through 12 and references 5 through 7 are the cases where an aqueous penetrant solution was either applied or not applied. The evaluation method is as shown below.

EVALUATION OF PRINTING MOTTLE IN PRINTED MATTER

An RI printer (mfd. by Akira Works) was used to stretch the first color, 0.5 ml of Toyo King Mark V New CC, dark blue ink (mfd. by Toyo Ink), and then the second color, 0.3 ml of Toyo King Mark V T=13, red ink (by Toyo Ink), over the first color, with the time interval between the first and second ink application varied, and the mottling of the second red ink was visually surveyed and evaluated.

⊙: Excellent (little printing mottle)

○: Good (a small amount)

Δ: Poor (printing mottle is slightly recognized)

X: Bad (a great deal of printing mottle is recognized)

EMBODIMENT 1

Preparation of the coating color

A pigment consisting of 30 parts of ground calcium carbonate (tradename: FMT-90/Fimatic, Inc.) and 70 parts of kaolin (tradename: Amazon 88/CADAM, Inc.) was dispersed in water by means of a Cowles dissolver to obtain a pigment slurry, in which was then added and dispersed 10 parts (solids) of styrene-butadiene copolymer latex (tradename: SN307/Sumitomo Dow, Ltd.), 5 parts (solids) of oxidized cooked starch (tradename: Ace A/oji Cornstarch Co.), 0.2 parts of waterproofing agent (tradename: Denacol 1000/Nagase Synthetic Chemical Co.), 0.2 parts of lubricant (tradename: Nopcote C-104/San Nopco, Ltd.) and other sub-agents to obtain a coating color with a 55% solids concentration. Manufacture of the coated paper The above coating color was applied to both sides of a base paper weighing 87.9 g/m$^2$ with a blade coater so that the coating color would be 15 g/m$^2$ in dry weight per side, and then dried by heat so that the moisture content of the paper was 6.0%, to obtain the coated paper for printing. Next, steam was sprayed over the dried coated layer surface so that the amount of wetting steam applied would be 0.8 g/m$^2$. Then the coated paper was wound up and 5 minutes later, processed with a supercalender to obtain a coated paper for printing with a weight of 117.9 g/m$^2$. By the way, the steam used here was a low-pressure (0.3 kg/cm$^2$) steam with a flow rate of 50 kg/Hr/m.

EMBODIMENT 2

A coated paper for printing was obtained in a similar way to embodiment 1 except that after steam dampening, the coated paper was wound up and left for 24 hours before being finished by the supercalender.

EMBODIMENT 3

A coated paper for printing was obtained in a similar way to embodiment 1 except that the amount of steam applied was 2.0 g/m$^2$ per side, and the coated layer was dried after steam dampening so that its moisture content was 6.0% before calendering. By the way, the steam used here was a low-pressure (0.7 kg/cm$^2$) steam with a flow rate of 120 kg/Hr/m.

EMBODIMENT 4

A coated paper for printing was obtained in a similar way to embodiment 1 except that a pigment consisting of 50 parts of ground calcium carbonate (tradename: FMT-90/Fimatic, Inc.), 47 parts of kaolin (tradename: UW-90/Engelhard, Inc.) and 3 parts of satin white (tradename: Satin White BL/Shiraishi Kogyo Kaisha, Ltd.) was used, 7 parts of cold water soluble starch (tradename: High Coaster PC-11/Sanwa Denpun Kogyo Co., Ltd.) were added in place of the oxidized cooked starch, and no waterproofing agent was added.

EMBODIMENT 5

A coated paper for printing was obtained in a similar way to embodiment 4 except that the amount of steam applied was 2.0 g/m$^2$ per side, and the coated paper was dried after the steam application so that its moisture content was 6.0%. By the way, the steam used here was a low-pressure (0.7 kg/cm$^2$) steam with a flow rate of 120 kg/Hr/m.

EMBODIMENT 1

A coated paper for printing was obtained in a similar way to embodiment 1 except that the amount of steam applied was 0.1 g/m$^2$ per side. The steam used here was a low-pressure (0.3 kg/cm$^2$) steam with a flow rate of 7 kg/Hr/m.

REFERENCE 2

A coated paper for printing was obtained in a similar way to embodiment 3 except that the steam application was done immediately before calendering and the coated paper was calendered with its coated layer surface remaining wet. The soiling of the calender rolls occurred, making the product unuseable.

REFERENCE 3

A coated paper for printing was obtained in a similar way to embodiment 3 except that the amount of steam applied was 5 g/m$^2$ per side. The steam used here was a low-pressure (0.7 kg/cm$^2$) steam with a flow rate of 250 kg/Hr/m.

REFERENCE 4

A coated paper for printing was obtained in a similar way to embodiment 3 except that after the steam application, the coated paper was wound up without being dried. Since the coated layer surface was wet immediately before the coated paper was wound up, blocking occurred during the winding up, making the product unuseable.

EMBODIMENT 6

Nonylphenol ethoxylate with a HLB of 12 was used as the penetrant. An aqueous 0.3% solution of the nonylphenol ethoxylate was prepared, then the penetrant solution was applied to both surfaces of the coated paper described in Embodiment 1 with an air-knife coater in an amount of 4 g/m$^2$ per side, and then dried by blowing hot air so that the moisture content was 6.0% after drying. Then the coated paper was processed with a super-calender to obtain a coated paper for printing which weighed 117.9 g/m$^2$. By the way, the penetrating force (velocity) of this aqueous 0.3% penetrant solution was 12 seconds according to the canvas disk method.

EMBODIMENT 7

A coated paper for printing was obtained in a similar way to embodiment 6 except that the amount of aqueous penetrant solution applied to the coated paper was 7 g/m$^2$ per side.

EMBODIMENT 8

A coated paper for printing was obtained in a similar way to embodiment 6 except that the concentration of the penetrant solution was changed to 0.5%. The penetrating force of this penetrant solution was 3 seconds according to the canvas disk method.

EMBODIMENT 9

A coated paper for printing was obtained in a similar way to embodiment 6 except that the aqueous penetrant solution was replaced with an aqueous solution of 0.2% dialkyl sulpho succinic acid ester. The penetrating force of this penetrant solution was 38 seconds according to the canvas disk method.

EMBODIMENT 10

A coated paper for printing was obtained in a similar way to embodiment 6 except that a pigment consisting of 50 parts of ground calcium carbonate (tradename: FMT-90/Fimatic, Inc.), 47 parts of kaolin (tradename: UW-90/Engelhard, Inc.) and 3 parts of satin white (tradename: Satin White BL/ Shiraishi Kogyo Kaisha Ltd.) was used, 7 parts of cold water-soluble starch (tradename: High Coaster PC-11/ Sanwa Denpun Kogyo Co.) were added in place of the oxidized cooked starch, and no waterproofing agent was added.

EMBODIMENT 11

A coated paper for printing was obtained in a similar way to embodiment 8 except that the aqueous penetrant solution was replaced with an aqueous solution of 0.2% dialkyl sulpho succinic acid ester. The penetrating force of this penetrant solution was 38 seconds according to the canvas disk method.

EMBODIMENT 12

A coated paper for printing was obtained in a similar way to embodiment 6 except that the application of penetrant solution to the coated paper surface was done with a gravure coater.

REFERENCE 5

A coated paper for printing was obtained in a similar way to embodiment 6 except that the aqueous penetrant solution was replaced with water. The penetrating force of this water was more than 1000 seconds (unmeasurable) according to the canvas disk method.

REFERENCE 6

A coated paper for printing was obtained in a similar way to embodiment 6 except that the aqueous penetrant solution was replaced with an aqueous solution of 0.1% nonylphenol ethoxylate with a HLB of 14, and that the amount of the solution applied was 4 g/m$^2$ per side. The penetrating force of this aqueous 0.1% penetrant solution was 100 seconds according to the canvas disk method.

REFERENCE 7

A coated paper for printing was obtained in a similar way to embodiment 6 except that the penetrant solution was replaced with an aqueous solution of 0.1% aromatic phosphoric acid ester salt and that the amount of said solution applied was 4 g/m$^2$. The penetrating force of this aqueous penetrant solution was 300 seconds according to the canvas disk method.

EMBODIMENT 13

A coated paper for printing was obtained in a similar way to embodiment 6 except that the amount of penetrant solution in embodiment 6 was changed into 1.0 g/m$^2$ per side.

EMBODIMENT 14

A coated paper for printing was obtained in a similar way to embodiment 6 except that the amount of penetrant solution in embodiment 6 was changed into 12 g/m$^2$ per side.

Tables 1 and 2 show the results of the evaluation of printed ink mottling on the coated papers obtained above. These tables represent the cases when steam was applied and when the penetrant solution was applied, respectively.

TABLE 1

| | PRINTING MOTTLE |
|---|---|
| Embodiment 1 | ◎ |
| Embodiment 2 | ◎ |
| Embodiment 3 | ○ |
| Embodiment 4 | ◎ |
| Embodiment 5 | ○ |
| Reference 1 | X |
| Reference 2 | Evaluation impossible *1 |
| Reference 3 | X |
| Reference 4 | Evaluation impossible *2 |

*1: The product value was lost due to the soiling of calender roll.
*2: The product value was lost due to blocking of coated paper.

TABLE 2

| | PENETRANT | | | | | |
|---|---|---|---|---|---|---|
| | Composition | HLB | Penetrating force (sec) | Concentration (%) | Amount used (g/m$^2$) | Printing mottle |
| Embodiment 6 | Nonylphenol ethoxylate | 12 | 12 | 0.3 | 4 | ◎ |
| Embodiment 7 | Nonylphenol ethoxylate | 12 | 12 | 0.3 | 7 | ◎ |
| Embodiment 8 | Nonylphenol ethoxylate | 12 | 3 | 0.5 | 4 | ◎ |
| Embodiment 9 | Dialkylsulfosuccinic acid ester salts | — | 38 | 0.2 | 4 | ○ |
| Embodiment 10 | Nonylphenol ethoxylate | 12 | 12 | 0.3 | 4 | ◎ |
| Embodiment 11 | Dialkylsulfosuccinic acid ester salts | — | 38 | 0.2 | 4 | ○ |
| Embodiment 12 | Nonylphenol ethoxylate | 12 | 12 | 0.3 | 4 | ◎ |
| Embodiment 13 | Nonylphenol ethoxylate | 12 | 12 | 0.3 | 1 | Δ |
| Embodiment 14 | Nonylphenol ethoxylate | 12 | 12 | 0.3 | 12 | Δ |
| Reference 5 | Water | — | 1000< | — | 4 | X |
| Reference 6 | Nonylphenol ethoxylate | 14 | 100 | 0.1 | 4 | X |
| Reference 7 | Aromatic phosphoric acid ester salts | — | 300 | 0.1 | 4 | X |

As is clearly indicated by Tables 1 and 2, it was confirmed that the process according to the present invention can produce a coated paper for use in printing which can successfully prevent the occurrence of printing mottle and can therefore have more favorable print finish than before.

We claim:

1. A process for manufacturing a coated paper used in printing, said process comprising the steps of: coating a layer containing a color-containing pigment and a water-soluble binder on a base paper surface, said binder comprising at least one member selected from the group consisting of a starch and a starch derivative; drying the coated paper surface; applying an aqueous penetrant solution to the dried coated paper surface in an amount of 1~1 g/m$^2$ to redistribute the water-soluble binder in the coating layer, said aqueous penetrant solution having a penetrating force of less than 50 seconds as determined by the canvas disk method; drying the coated paper; and finishing the dried coated paper with a calender.

2. A process as defined in claim 1, wherein an aqueous penetrant solution with a penetrating force of less than 30 seconds is used as the aqueous penetrant solution.

3. The process as defined in claim 1, wherein at least one member selected from the group consisting of carboxyl methyl cellulose, hydroxy ethyl cellulose, polyvinyl alcohol, and olefin-maleic anhydride resin is contained in said water-soluble binder.

4. The process as defined in claim 2, wherein at least one member selected from the group consisting of carboxyl methyl cellulose, hydroxy ethyl cellulose, polyvinyl alcohol, and olefin-maleic anhydride resin is contained in said water-soluble binder.

5. The process as defined in claim 1, wherein said coating layer contains at least one substance selected from the group consisting of a conjugated diene-based copolymer latex, an acrylic polymer latex, a vinyl-based polymer latex, an alkali-soluble polymer, an alkali-insoluble polymer and a copolymer latex made by denaturing a copolymer latex with a functional group-containing monomer.

6. The process as defined in claim 2, wherein said coating layer contains at least one substance selected from the group consisting of a conjugated diene-based copolymer latex, an acrylic polymer latex, a vinyl-based polymer latex, an alkali-soluble polymer, an alkali-insoluble polymer and a copolymer latex made by denaturing a copolymer latex with a functional group-containing monomer.

7. The process-as defined in claim 1, wherein 2–6 $g/m^2$of aqueous penetrant solution is applied to the dried coated paper surface.

* * * * *

UNITED STATES PATENT AND TRADEMARK OFFICE

CERTIFICATE OF CORRECTION

PATENT NO. : 5 789 031

DATED : August 4, 1998

INVENTOR(S) : Tetsuya HIRABAYASHI et al

It is certified that error appears in the above-identified patent and that said Letters Patent is hereby corrected as shown below:

Column 10, line 63; change "1~1 $g/m^2$" to
---1~10 $g/m^2$---.

Column 11, line 1; change "A process" to
---The process--.

Column 12, line 12; change "process-as" to
---process as---.

Signed and Sealed this

Fifteenth Day of December, 1998

Bruce Lehman

*Attest:*

BRUCE LEHMAN

*Attesting Officer*

*Commissioner of Patents and Trademarks*